United States Patent [19]

Fassio

[11] 4,427,850

[45] Jan. 24, 1984

[54] MONOSTABLE SWITCH DEVICE FOR CONTROLLING THE REAR WINDOW WASHER/WIPER OF AN AUTOMOBILE

[75] Inventor: Felice Fassio, Asti, Italy

[73] Assignee: Fiat Auto S.p.A., Turin, Italy

[21] Appl. No.: 377,767

[22] Filed: May 13, 1982

[30] Foreign Application Priority Data

May 29, 1981 [IT] Italy ..... 67719 A/81

[51] Int. Cl.[3] ..... H01H 21/22

[52] U.S. Cl. ..... 200/6 R; 200/6 BA; 200/61.54

[58] Field of Search ..... 200/6 R, 6 A, 6 B, 6 BA, 200/6 BB, 6 C, 61.27–61.38, 61.54

[56] References Cited

U.S. PATENT DOCUMENTS 3,978,542 9/1976 van Eekelen et al. ..... 15/250.30

4,006,328 2/1977 Kimberlin et al. ..... 200/61.27 X

*Primary Examiner*—Elliot A. Goldberg

*Assistant Examiner*—Morris Ginsburg

*Attorney, Agent, or Firm*—Sughrue, Mion, Zinn, Macpeak and Seas

[57] ABSTRACT

A monostable switch device for controlling the rear window washer/wiper of an automobile, is incorporated into the steering-column control switch unit. Operation of the rear window washer/wiper switch device is effected by manual rotation of the windscreen wiper control lever about its longitudinal axis against a bias provided by a resilient tongue formed internally of the control-switch unit body. Rotation of the lever serves to displace a movable switch element whereby to complete the rear window washer/wiper energisation circuit; this circuit only remains completed through the monostable switch device for as long as the windscreen wiper control lever is held in its rotated position against the bias force.

1 Claim, 3 Drawing Figures

MONOSTABLE SWITCH DEVICE FOR CONTROLLING THE REAR WINDOW WASHER/WIPER OF AN AUTOMOBILE

BACKGROUND OF THE INVENTION

The present invention relates to a monostable switch device for controlling the rear window washer/wiper of an automobile and, in particular, to such switch devices incorporated into the control-switch unit mounted on the steering-column housing of the automobile.

As is well known in the automotive art, the steering-column control switch unit of an automobile now generally comprises a body from one side of which extend two manually-operable levers for respectively controlling the operation of the direction indicator lights, and of the parking lights and dipped and full headlights. Projecting from the other side of the control-switch unit body is generally a third lever which when pressed by the driver sets in motion the windscreen wiper blades and, additionally, by a push button action causes liquid detergent to be delivered from a reservoir onto the windscreen by a pump.

Due to this arrangement, control of the corresponding automobile services can be effected by the driver in a convenient and simple manner since the control levers are ready to hand. Furthermore, the various electrical and mechanical connections required for assembling and mounting the control switch unit can be readily effected.

In some types of automobiles, a rear window washer/wiper is provided. In this case, the operating button or lever for the rear window washer/wiper has invariably been disposed on the automobile dashboard rather than in the steering-column control switch unit. As a result of this, the electrical and mechanical connections for the rear window washer/wiper control must be effected during assembly separately to those carried out during the fitting of the steering-column control-switch unit.

This causes production costs to be very high on account both of the additional operations which the assembly worker must carry out, and of the unit cost of the control button or lever for the rear window washer/wiper.

The present invention seeks to produce a monostable switch device for a rear window washer/wiper which avoids these drawbacks, is low in cost and easy to manufacture.

SUMMARY OF THE INVENTION

The present invention achieves this object by the provision of a monostable switch device, for controlling a rear window washer/wiper, which is incorporated into the steering-column control switch unit controlling the windscreen wiper, the device including a switch arranged to be operated by rotation of the windscreen wiper control lever about its longitudinal axis, and biassing means normally biassing the lever into an angular position corresponding to the open state of the switch.

BRIEF DESCRIPTION OF THE DRAWINGS

A monostable switch device embodying the invention and for controlling a rear window washer/wiper, will now be particularly described, by way of example, with reference to the accompanying diagrammatic drawings, in which.

DESCRIPTION OF THE PREFERRED EMBODIMENT

Figure 1:
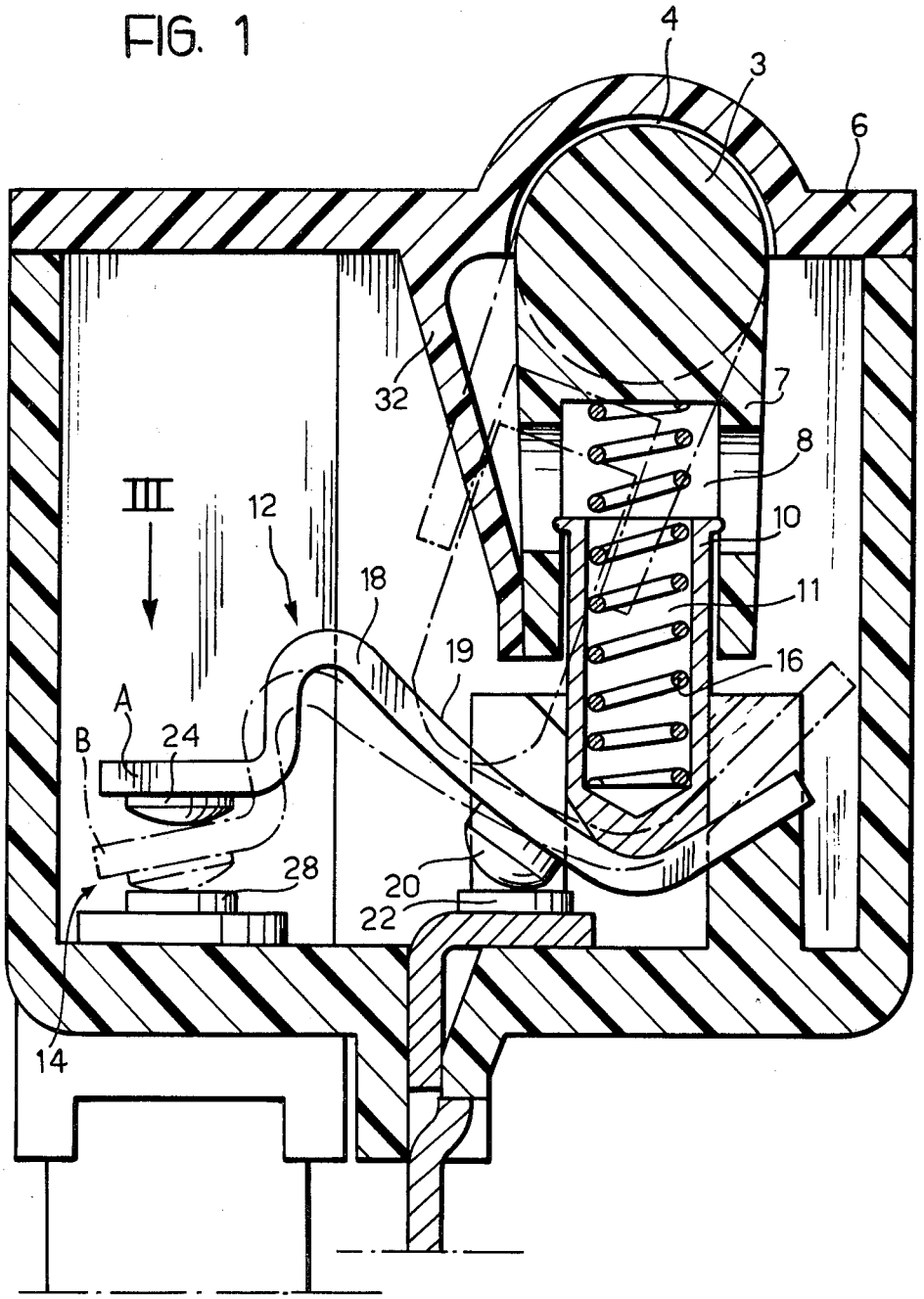
FIG. 1 is a sectional view through part of the body of a steering-column control-switch unit showing one end of a windscreen wiper control lever and components of the monostable switch device embodying the present invention.

Referring first to FIG. 1, one end of a windscreen wiper control lever 3 is shown projecting through a slot 4 into the interior of the body 6 of the steering-column control switch unit. As is standard, this control lever 3 can be depressed to operate the windscreen wipers and pushed at its external end, like a push-button, to operate the windscreen washer pump. For reasons which will become clear hereinafter, the windscreen control lever 3 is also mounted for rotation about its longitudinal axis in the body 6.

The inner end of the control lever 3 is shaped as a sleeve 7 projecting at right angles to the longitudinal axis of the lever 3 and within which is formed a chamber 8. An operating pin 10 provided with a blind hole 11 is slidingly housed within the chamber 8. The end of the operating pin 10 which projects from the chamber 8 is spherical in shape and contacts a rounded section of the movable part 12 of a two-state monostable switch 14; this rounded section forms a positive seat for the projecting end of the pin 10.

Disposed between the bottom of the chamber 8 of the sleeve 7 and the bottom of the blind hole 11 of the operating pin 10 is a spring 16 which serves to maintain the operating pin 10 under pressure against the movable part 12 of the switch 14.

Figure 3:
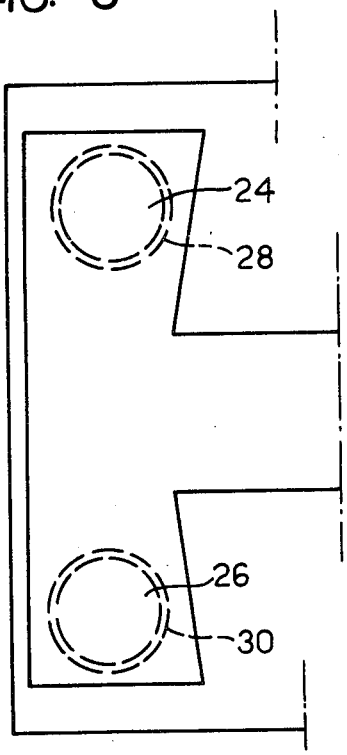
FIG. 3 is a view, in the direction of arrow III in FIG. 1, showing contacts of the monostable switch device.

The movable part 12 of the switch 14 comprises a lamina of conductor material 18 which is shaped generally as an inclined plane 19 and is provided both with a first moving contact 20 which rests constantly upon, and can rock back and forth over, a first fixed contact 22 of the switch 14, and with a second and a third moving contact 24 and 26 (see FIG. 3). The latter contacts 24 and 26 can be moved into contact with a second and a third fixed contact 28 and 30 of the switch 14.

A resilient tongue 32 is formed within the body 6 and is so shaped as to remain constantly in contact under pressure with a part of the external surface of the sleeve 7. The tongue 32 thus exerts a biassing moment on the lever 3 and thereby serves to normally maintain the lever 3 in a first angular position about its longitudinal axis, the lever being rotatable by action of the automobile driver from its first angular position into a second angular position against the biassing moment of the tongue 32.

As will be more fully described hereinafter, rotation of the lever 3 about its longitudinal axis between its first and second angular positions is effective to switch the monostable switch 14 between its two limit states, these states being an open switch state (indicated by A in FIG. 1 and shown in continuous outline) and a closed switch state (indicated by B and shown in dashed outline). The open and closed states of the switch 14 are respectively stable and unstable inasmuch as the switch 14 can only be maintained in its closed state by the application of a sufficient moment to the lever 3, by the automobile driver, to overcome the biassing moment of the tongue 32 and hold the lever 3 in its second angular position.

When the windscreen wiper control lever 3 is rotated from its normal position (in which the switch 14 is open), the spherical end of the operating pin 10 is displaced from its seat within the rounded section of the movable switch part 12, through a certain distance along the inclined plane 19 of the latter until; as a result of this displacement, the moving contacts 24 and 26 move into contact with the fixed contacts 28 and 30. The switch 14 is now in its closed state.

When the lever 3 is released by the automobile driver, the biassing moment exerted by the tongue 32 causes the sleeve 7, and therefore the operating pin 10, to return to their initial positions, as a result of which the moving contacts 24 and 26 disengage the fixed contacts 28 and 30.

Figure 2:
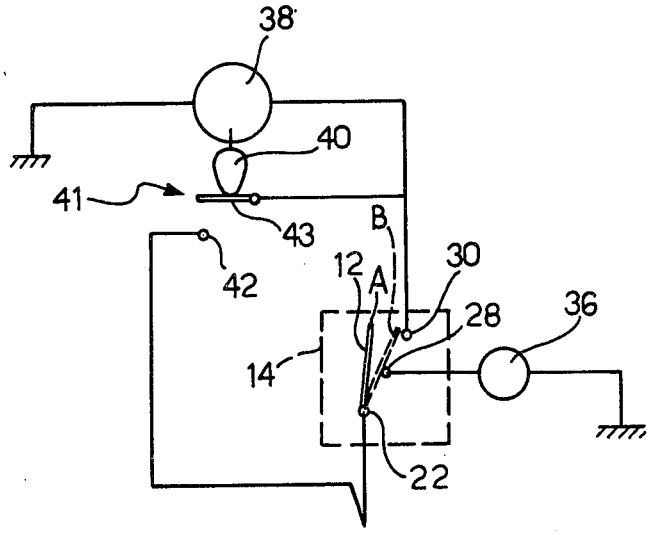
FIG. 2 is a diagrammatic representation of the electrical circuit in which the rear window washer/wiper and its controlling monostable switch device are incorporated.

The switch 14 which incorporates the movable part 12 and the fixed contacts 22, 28 and 30 is shown diagrammatically in FIG. 2. As in FIG. 1, the positions of the switch part 12 corresponding to the open and closed state of the switch 14 are referenced A and B respectively in FIG. 2.

The final contact 22 of the switch 14 is connected to one terminal of the automobile's voltage source (battery, generator, not shown) the other terminal of which is earthed. When in position B (the driver-maintained switch state), the movable part 12 of the switch 14 serves to electrically connect the two fixed contacts 28 and 30 to the contact 22 and thereby close the electrical connection between the voltage source and one terminal of an electric pump 36 and one terminal of an electric motor 38, the other terminals of the pump 36 and motor 38 being earthed.

This electric pump, in addition to delivering liquid detergent from a reservoir, (not shown), to the automobile windscreen, also serves to deliver this liquid through various tubes to the rear window.

The shaft of the electric motor 38 carries a cam 40 which is arranged to operate a normally-open switch 41. The switch 42 includes a fixed contact 42 connected to the automobile's voltage source, and a movable contact 43 connected to the un-earthed terminal of the motor 38. The profile of the cam 40 is such that during a predetermined portion of each revolution of shaft of the electric motor 38, the cam 40 pushes the movable contact 43 into contact with the fixed contact 42, thereby closing the electrical connection between this motor and the voltage source. However, as the cam 40 continues to rotate, a point is reached during its cycle of rotation when the contacts of the switch 41 disengage thereby interrupting the electrical connection between the motor and the voltage source via the switch 41.

The motor 38 is also connected mechanically to a rear window washer/wiper blade and causes the blade to move cyclically back and forth over the rear window in synchronism with rotation of the cam 40. By appropriate setting of the cam 40 on the motor shaft, the contacts 42, 43 of the switch 41 are arranged to open only when the rear window wiper blade is in a parking position, normally at one extreme of its cycle motion, in which its obstruction of the rearward field of view of the driver is minimal.

Operation of the monostable switch device will now be described.

Manual rotation of the windscreen wiper control lever 3 about its axis from its normal first angular position, causes the spherical end of the operating pin 10 to be displaced sufficiently far along the inclined plane 19 of the movable part 12 to cause the switch 14 to move into its closed state in which the moving contacts 24 and 26 engage the fixed contacts 28 and 30. As a result, the electrical connection between the automobile's voltage source and the electric pump 36 and beween this source and the electric motor 38 is completed.

Upon energisation, the motor 38 moves the rear window washer/wiper blade over the rear window.

Energisation of the electric pump 36 causes it to deliver a certain quantity of liquid detergent from the reservoir onto the rear window.

When the windscreen wiper control lever 3 is released by the driver, it automatically returns to its first position under the bias applied by the tongue 32, thereby displacing the sleeve 7 and the operating pin 10 to their original positions. This displacement causes the moving contacts 24 and 26 to disengage from the fixed contacts 28 and 30. The electrical connection through the switch 14 between the voltage source and the electric motor 38 and between the source and the electric pump 36 is thus interrupted.

As a consequence the electric pump is de-energised and the flow of liquid detergent from the reservoir to the rear window ceases.

The electric motor 38, will, however, continue to be energised via the switch 41 until the cam 40 rotates into a position in which the contacts 42, 43 open, this position corresponding to the rear window wiper blade being in its parking position.

Thus, regardless of how long the lever 3 is kept in its second position in which both the motor 38 and pump 36 are energised, upon release of the lever, the energisation of the motor will be maintained until the rear window wiper blade has reached its parking position; thereafter, the motor will become de-energised unless and until the lever 3 is rotated again into its second position.

I claim:

1. A switch device for controlling a rear window washer/wiper of an automobile comprising a switch unit body adapted to be mounted on the steering column in said automobile, an electrical switch housed within said switch unit body and including a moveable part displaceable between a first position corresponding to an open condition of said switch and a second position corresponding to a closed position of said switch, a control arm rotatably mounted in said body for rotation about the longitudinal axis of the arm between first and second predetermined angular positions, switch operating means mechanically interconnecting said control arm and said moveable part of said switch such that manual rotation of said arm from its first position to said second position causes displacement of said moveable part from its first position to its second position to close said switch and biasing means comprised of a resilient tongue of integral one piece construction with said body and disposed in operative engagement with said switch operating means for biasing said switch operating means and said control arm to said first positions respectively upon release of said control arm.

* * * * *